US006220124B1

(12) United States Patent
Perkins

(10) Patent No.: US 6,220,124 B1
(45) Date of Patent: Apr. 24, 2001

(54) FIRE HYDRANT WRENCH

(75) Inventor: Kenneth A. Perkins, Salem, OR (US)

(73) Assignee: Speed Set, Inc., Salem, OR (US)

( * ) Notice: Subject to any disclaimer, the term of this patent is extended or adjusted under 35 U.S.C. 154(b) by 0 days.

(21) Appl. No.: 09/262,456

(22) Filed: Mar. 4, 1999

(51) Int. Cl.[7] ..... B25B 13/16
(52) U.S. Cl. ..... 81/174; 81/155
(58) Field of Search ..... 81/155, 174, 176, 81/157, 158, 164

(56) References Cited

U.S. PATENT DOCUMENTS

| | | | | |
|---|---|---|---|---|
| 560,220 | * | 5/1896 | Klose | 81/106 |
| 1,096,317 | * | 5/1914 | Peoples | 81/134 |
| 1,201,739 | * | 10/1916 | Johnston et al. | 81/158 |
| 3,662,630 | * | 5/1972 | Baxter | 81/97 |
| 4,690,019 | * | 9/1987 | Daghe et al. | 81/99 |
| 5,255,576 | | 10/1993 | Keith . | |
| 5,392,672 | | 2/1995 | Larson et al. . | |

FOREIGN PATENT DOCUMENTS

| | | | | |
|---|---|---|---|---|
| 83349 | * | 5/1920 | (CH) | 81/157 |
| 544343 | * | 6/1922 | (FR) | 81/158 |
| 558845 | * | 1/1944 | (GB) | 81/158 |

OTHER PUBLICATIONS

Photocopy of prior art tubing cutter marked with the RIDGID brand name (photocopy made from actual tool, before filing date of the application). WWW.RIDGID.COM.

* cited by examiner

*Primary Examiner*—James G. Smith
*Assistant Examiner*—Hadi Shakeri
(74) *Attorney, Agent, or Firm*—Klarquist Sparkman Campbell Leigh & Whinston, LLP

(57) ABSTRACT

A fire hydrant wrench is provided with a chatter-thread arrangement that permits a threaded handle to be pushed, rather than manually threaded, into engagement with a fire hydrant fixture. A quick release trigger similarly permits the handle to be quickly withdrawn without unthreading. Faster operation of hydrants, with consequent savings of lives, results. Other improvements are also disclosed, including reversible, replaceable gripping teeth that tend to prevent even a loosely coupled wrench from falling off a fire hydrant.

16 Claims, 4 Drawing Sheets

FIG. 14a
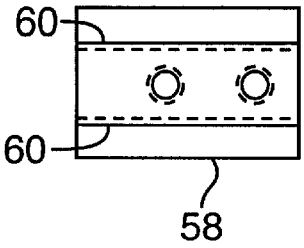
FIG. 14b
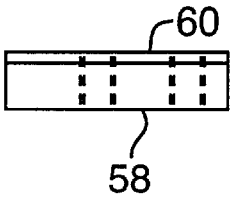
FIG. 14c
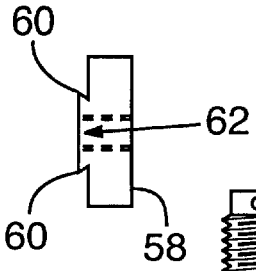
FIG. 15a
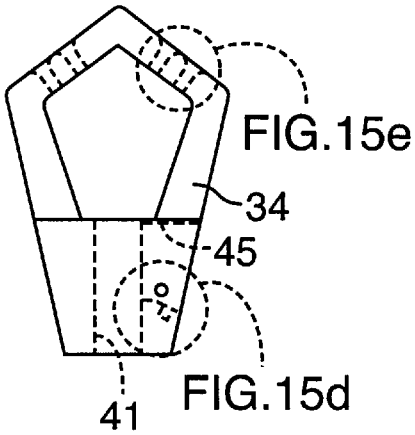
FIG. 15b
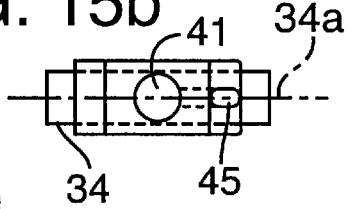
FIG. 15c
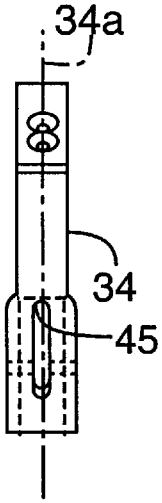
FIG. 15d
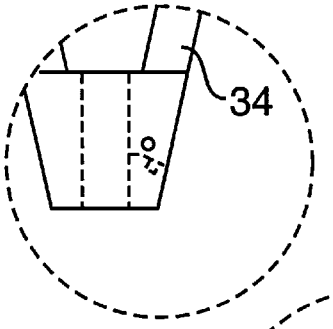
FIG. 15e
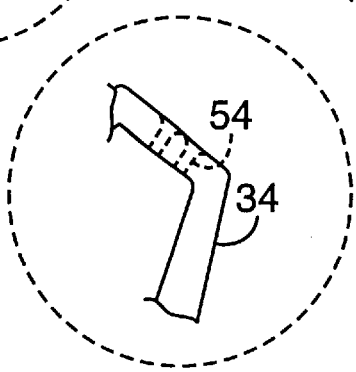
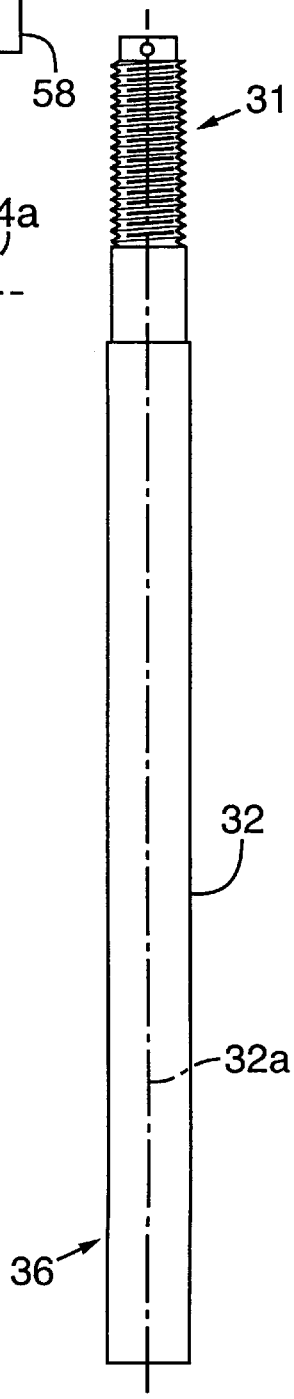
FIG. 16

FIRE HYDRANT WRENCH

FIELD OF THE INVENTION

The present invention relates to wrenches, and more particularly relates to wrenches adapted for rapid use on fire hydrant fixtures.

BACKGROUND AND SUMMARY OF THE INVENTION

Wrenches especially adapted for use on fire hydrants have been the subject of patents for many years. An example is detailed in U.S. Pat. No. 4,690,019, a simplified version of which is illustrated in FIG. 1.

The illustrated wrench 10 includes a head 12 and a handle 14. An end 16 of the handle is fashioned with helical threads 18 designed to mate with corresponding threads in a base end 20 of the head.

In use, a firefighter must unthread the handle 14 from the head 12 enough to accommodate the fire hydrant fixture (e.g. a five-sided bolt head) in an opening 22. Then the firefighter must thread the handle back into the head in order to grip the fixture in the opening 22 prior to turning. This is a time-consuming sequence of operations. While in many contexts "time is money," in case of fire, time can be a matter of life or death.

The inherently slow unthread/thread operation of prior art wrenches is not their only drawback. Another is the time that can be lost fumbling with a wrench that falls off a hydrant. Due to the urgency of time, the firefighter typically does not thread the handle into the head to tightly grip the hydrant fixture. Instead, the handle is loosely coupled to the fixture—tightened only enough to avoid the wrench head from idly spinning around the fixture when the firefighter applies rotating torque. When the firefighter lets go of the wrench, the loose coupling often permits the wrench to fall off the hydrant onto the ground.

In accordance with an illustrative embodiment of the present invention, the foregoin, drawbacks of the prior art are overcome.

According to one aspect of the invention, a fire hydrant wrench is provided with a "chatter thread" arrangement that allows the firefighter to avoid much, if not all, of the handle-turning required in the prior art to attach a wrench to a hydrant.

According to another aspect of the invention, a fire hydrant wrench is provided with a release trigger that permits the wrench to be quickly disengaged from a hydrant.

According to another aspect of the invention, a fire hydrant wrench is provided with reversible means (e.g. gripper teeth) tending to prevent even a loosely coupled wrench from falling off a fire hydrant.

The foregoing and other features and advantages of the present invention will be more readily apparent from the following detailed description, which proceeds with reference to the accompanying drawings.

BRIEF DESCRIPTION OF THE DRAWINGS

FIGS. 14*a–c* are additional views of the gripping tooth shown in FIG. 6.

FIGS. 15*a–e* show further details of the illustrated head.

FIG. 16 shows an alternative handle that is not as extensively threaded as the handle of FIG. 8.

PREFERRED EMBODIMENT

Figure 8:
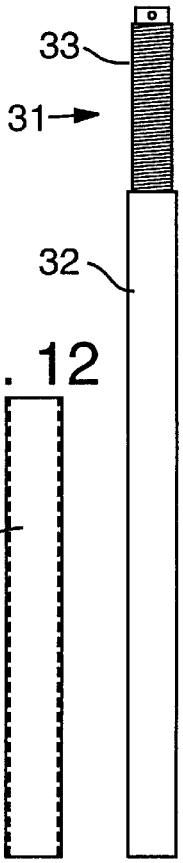
FIG. 8 shows a handle used in the wrench of FIGS. 2–4.

Referring to FIGS. 2–15, a preferred embodiment 30 of the present invention includes an elongate handle 32 and a head 34. The handle 32 is similar to handles used in the prior art, including helical threads 33 (FIG. 8) cut at one end 31 and having a longitudinal axis 32*a* (see FIG. 16). A cap 37 is mounted on this end and provides a flat edge to urge against a fire hydrant fixture (e.g. a bolt or valve operating stem).

The opposite end 36 of the handle is brightly colored to facilitate location of the wrench in tall grass or under adverse lighting conditions. One way of providing the bright coloring is by a plastic tube 38 that encases the end 36 of the handle. The tube can be colored hunter orange, or other luminescent color, and can be heat-shrunk in place on the metal of the handle 32. Alternatively, the bright coloring can be provided by other known means including painting.

The head 34 has a principal, or central, plane 34*a* substantially parallel to longitudinal axis 32*a* of the handle (see FIGS. 15*b* and 15*c*) and includes several internal faces 35 defining an opening 39 for receiving a hydrant fixture. A base end 40 of the head has a passageway 41 into which the threaded end 31 of the handle 32 passes, as in the prior art. However, the passageway 41 is not threaded.

To secure the handle in the passageway 41 of the head 34, the wrench is provided with a chatter thread arrangement. This arrangement includes a pivotally-mounted member 43 having a radiused surface 44 that is cut with threads and urged, by a spring 48, against the threads of the handle. (This radius spans an arc of about 36 degrees.) The threads on this radiused surface are sized and spaced to engage those on the handle. However, the pivot pin 46 is positioned relative to the threaded surface 44 so that this member 43 pivots slightly out of the way when the threaded end 31 of the handle is pushed into the head 34. The threads on the radiused surface 44 of member 43 "chatter" against the passing threads 33 of the inserted handle, giving the structure its name. If the pushing force is removed, the member 43 is spring-biased towards the handle so that its threads on surface 44 engage the handle threads.

In the illustrated arrangement, member 43 is provided with a trigger protrusion 42 that serves as a quick release feature. When a user presses this protrusion inwardly, it causes the threaded surface 44 of member 43 (hereafter "trigger threads") to move away from and disengage the threads 33 on the handle 32, permitting free sliding movement of the handle.

In use, the firefighter first operates the quick release trigger and withdraws the handle from the head to the extent possible. (Cap 37 prevents the handle from being fully withdrawn.) The wrench is then placed so that the hydrant fixture is received within the head opening 39. To close the wrench, the firefighter simply pushes the handle into the head. The trigger 42 may, but needn't, be operated. (If the trigger isn't operated, the force of the handle threads against the trigger threads causes the trigger to repeatedly chatter aside, as described above.) The handle is pushed into the head until the cap 37 abuts the hydrant fixture. At this point, the firefighter can torque the wrench to turn the hydrant fixture. Alternatively (and this is not necessary), the firefighter can first manually turn the handle to cinch the end cap 37 tightly against the fixture. (Often less than a single turn, e.g. a quarter-turn, will suffice for this purpose.) This puts the threaded end 31 of the handle under compression. Such a force causes the member 43 to pivot towards the handle, forcing the threads on the handle and trigger into tighter engagement, preventing any slippage of the handle relative to the head.

To release the wrench from the fixture, the firefighter simply squeezes the trigger, disengaging its threads from the handle threads and permitting the handle to be withdrawn from the head. (If the firefighter cinched the cap 37 tightly against the fixture, the handle must first be counter-rotated slightly to remove the compressive force from end 31 of the handle before the trigger can be actuated to disengage the threads.)

Uncharacteristically for fire hydrant wrenches, the threads in the illustrated embodiment are finely spaced (e.g. 16 per inch, versus 10 or less per inch in the prior art). In the prior art, coarse thread pitch is desired because the handle then moves more quickly into engagement with the hydrant fixture when rotated. However, the fine pitch in the illustrated embodiment permits a finer positioning of the cap end relative to hydrant fixture when the handle is simply pressed (rather than threaded) into engagement.

Figure 1:
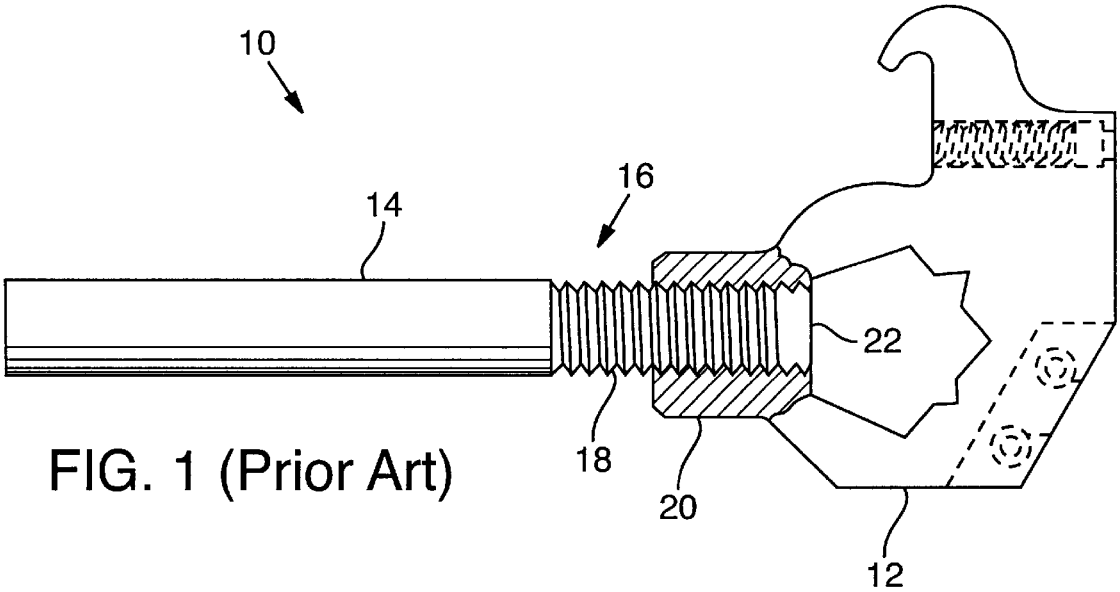
FIG. 1 (Prior Art)
FIG. 1 shows a prior art fire hydrant wrench.
Figure 2:
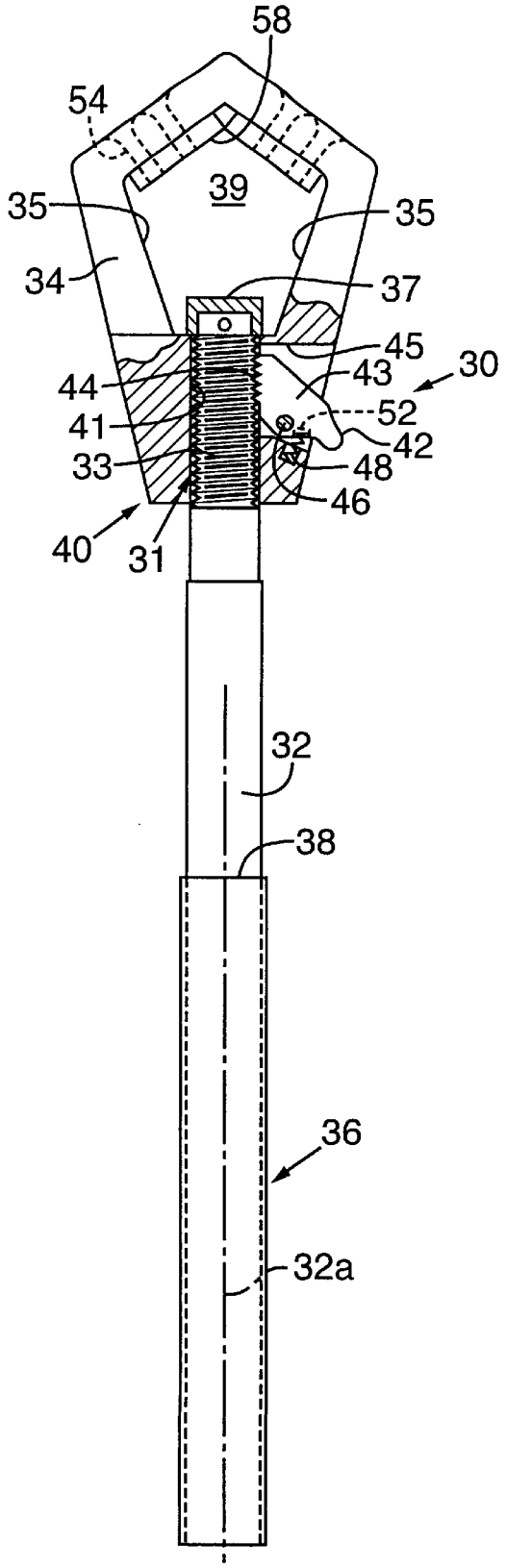
FIG. 2 shows a fire hydrant wrench according to one embodiment of the present invention in an "open" configuration.
Figure 3:
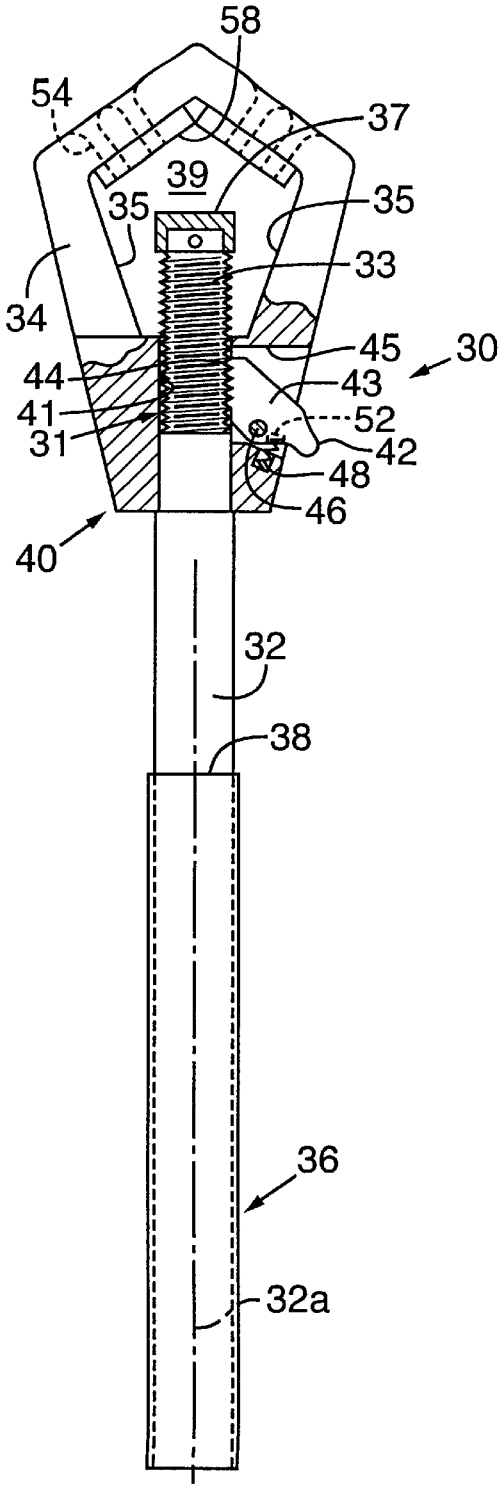
FIG. 3 is like FIG. 2, but shows the wrench after the handle has been moved into the head (e.g. to couple to a fire hydrant fixture).
Figure 4:
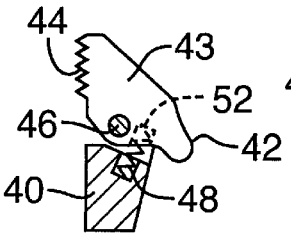
FIG. 4 is a detail showing the mounting of a spring in the FIG. 2 embodiment.
Figure 5:
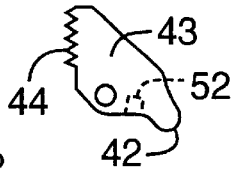
FIG. 5 shows a quick-release trigger used in the chatter-thread mechanism of the wrench of FIGS. 2–4.
Figure 6:
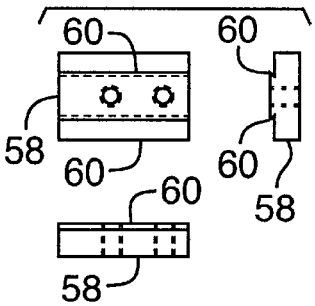
FIG. 6 shows one of two gripping teeth used in the wrench of FIGS. 2–4.
Figure 7:
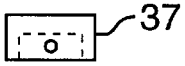
FIG. 7 shows a retaining cap used in the wrench of FIGS. 2–4.

Desirably, head 34 also includes one or more gripping teeth 58 (two teeth in the illustrated embodiment) fastened inside the opening 39 by recessed bolts 54. The teeth serve as faces 35 of the opening 39. The teeth, more particularly shown in FIGS. 6 and 14, are provided with sharp edges 60. These edges are oriented parallel to the principal plane 34*a* of the head, and serve to bind and engage the metal of the hydrant fixture. These edges 60 are angled out so that they act to prevent the wrench from falling off the hydrant feature, even if the wrench is only loosely coupled to the feature. (In the illustrated embodiment, the gripping teeth each includes a portion 62 in the shape of a non-rectangular trapezoid, although other shapes can naturally be used. As best illustrated in FIG. 14*c* contiguous faces of edge portions 60 have an included angle less than 90°.) The arrangement of the two edges assures at least one will grip, regardless of how the wrench is oriented (i.e. the arrangement is reversible).

The teeth 58 are formed of a relatively hard metal (e.g. A-2 tool steel). The remainder of the head is fashioned (e.g, forged) of more conventional steel (e.g. 8630 cast steel). The handle can be formed by various known techniques.

From the foregoing, it will be recognized that the preferred embodiment overcomes various drawbacks of the prior art. The chatter thread arrangement speeds use of the wrench to operate a fire hydrant. The quick-release trigger speeds disengagement of the wrench from a hydrant, and can be used to speed engagement as well. The gripping teeth help prevent the wrench from inadvertently dropping from the hydrant.

Having described and illustrated the principles of my invention with reference to a preferred embodiment, it will be apparent that the invention can be modified in arrangement and detail without departing from such principles.

For example, in alternative embodiments, the threaded end of the handle may not be fully threaded. For example, the top-most and bottom-most portions of the threading shown in the figures can be omitted, since the trigger threads never engage the handle in those regions, and—in the case of the top-most threading—it accelerates wear on the threads of the trigger. Moreover, having the bottom part of this region unthreaded avoids wear when the handle is subjected to a torquing force (which might deform threads near where the handle enters the head).

In other embodiments, the illustrated chatter-thread arrangement can be replaced by other known arrangements that perform similar functions (e.g. other sliding ratchet arrangements).

In still other embodiments, the quick release trigger can be constructed, or mounted, differently than shown.

In yet other embodiments, the threads on the handle may have other pitches, e.g. 12/inch, 14/inch, more than 16/inch, etc.

Figure 9:
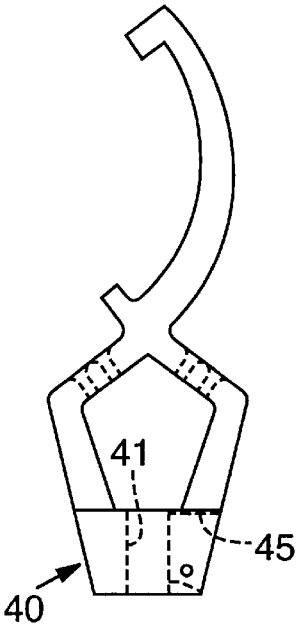
FIG. 9 shows a steamer port head that can be used in a first alternative embodiment.
Figure 10:
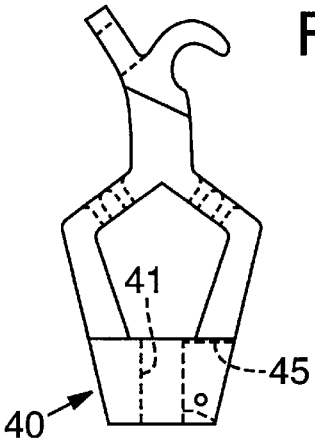
FIG. 10 shows a hose tool head that can be used in a second alternative embodiment.
Figure 11:
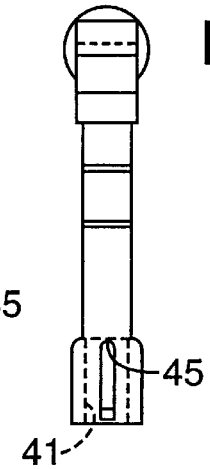
FIG. 11 is a side view of the hose tool head of FIG. 10.
Figure 12:
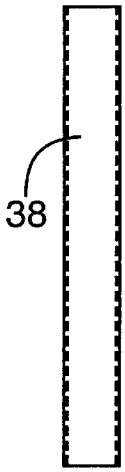
FIG. 12 shows a colored rubber handle cover used in the wrench of FIG. 2–4.
Figure 13A:
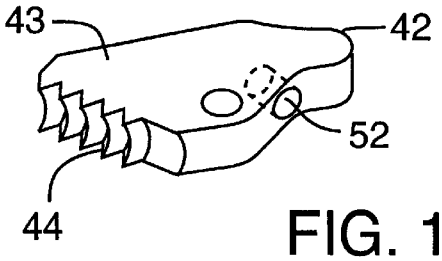
FIGS. 13*a–e* are additional views of the quick release trigger of FIG. 5.
Figure 13B:
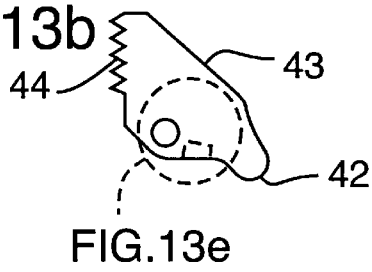
Figure 13C:
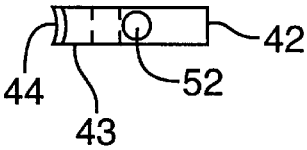
Figure 13D:
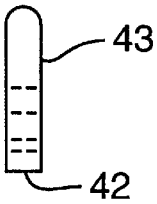
Figure 13E:
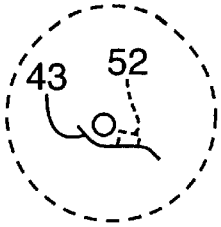

In still other embodiments, the head of the wrench may be provided with various utilitarian features, such as the steamer port and hose tools shown in FIGS. 9–11.

In yet other alternative embodiments, the gripping teeth can be integrally formed with the head, rather than removably attached thereto.

In yet other alternative embodiments, the wrench can be provided with certain of the disclosed features without others (e.g. a chatter thread arrangement without a quick-release trigger feature; gripper teeth without a chatter thread arrangement, etc.).

In still other embodiments, advantageous features shown in other prior art hydrant wrenches (e.g. those illustrated in U.S. Pat. Nos. 5,255,576 and 4,690,019, incorporated by reference) can be used in conjunction with the novel features of the preferred embodiment.

Many other such variations will be apparent to the artisans in the tool and/or hydrant arts.

In view of the wide variety of embodiments in which the principles of my invention can be employed, it will be recognized that the illustrated embodiment is exemplary only and should not be understood as limiting the scope of my invention. Rather, I claim as my invention all such embodiments as may come within the scope and spirit of the following claims, and equivalents thereto.

What is claimed is:

1. A fire hydrant wrench comprising:

a handle having threads on at least a first end thereof, and in which a second end of the handle is brightly colored;

a head having plural internal faces defining an opening to receive a hydrant fixture;

the head further defining a passageway for receiving the first end of the handle; and a chatter thread arrangement associated with said passageway, permitting the threaded first end of the handle to be pushed, rather than threaded, into the head.

2. The fire hydrant wrench of claim 1 in which said bright coloring is effected by a plastic covering on the handle.

3. A fire hydrant wrench comprising:

an elongate handle having helical threads on at least a first end thereof;

a head having plural internal faces defining an opening to receive a hydrant fixture, the head further defining a passageway for receiving the first end of the handle at least one of said internal faces includes a gripping edge, said edge having an included angle between contiguous faces thereof less than 90°, and being formed of a material harder than a material used for other of said internal faces; and a chatter thread arrangement associated with said passageway, permitting the threaded first end of the handle to be pushed, rather than threaded, into the head and further permitting the handle to be rotated about its longitudinal axis to be threadably tightened against the fixture after being pushed into the head.

4. The fire hydrant wrench of claim 3 in which the head has a principal plane and said gripping edge is oriented parallel to the principal plane of the head.

5. The fire hydrant wrench of claim 3 including at least two gripping edges, thereby providing the wrench with a reversible gripping capability.

6. The fire hydrant wrench of claim 3 in which said edge is removably mounted to facilitate replacement.

7. A fire hydrant wrench comprising:

a handle having threads on at least a first end thereof and the first end of the handle has a cap thereon, the cap having an outer diameter greater than a diameter of said first end;

a head having plural internal faces defining an opening to receive a hydrant fixture;

the head further defining a passageway for receiving the first end of the handle; and a chatter thread arrangement associated with said passageway, permitting the threaded first end of the handle to be pushed, rather than threaded, into the head.

8. A fire hydrant wrench comprising:

a head having plural internal faces defining an opening to receive a hydrant fixture;

an elongate handle having threads on at least a first end thereof, said threads permitting the handle to be threaded into the head to close onto the fixture; and a quick release member permitting the handle to be withdrawn from the head without unthreading;

at least one of said internal faces includes a gripping edge, said edge having an included angle of less than 90° between contiguous faces thereof and being formed of a material harder than a material used for other of said internal faces, and the head has a principal plane substantially parallel to the longitudinal axis of the handle and said gripping edge is oriented parallel to the principal plane of the head.

9. The fire hydrant wrench of claim 8 including at least two gripping edges, thereby providing the wrench with a reversible gripping capability.

10. The fire hydrant wrench of claim 8 in which said edge is removably mounted to facilitate replacement.

11. A fire hydrant wrench comprising:

a handle;

a head, the head having plural internal faces defining an opening to receive a hydrant fixture;

at least one gripping edge adjoining the opening, said gripping edge being formed of a material harder than a material used for other of said internal faces; and the handle has an end cap thereon to facilitate engagement with the hydrant fixture, and to prevent complete removal of the handle from the head.

12. The fire hydrant wrench of claim 11 wherein the head has a principal plane and said gripping edge is oriented parallel to the principal plane of the head.

13. The fire hydrant wrench of claim 11 wherein said gripping edge is formed on a member attached to the head by one or more threaded fasteners.

14. The fire hydrant wrench of claim 11 wherein said gripping edge includes a portion having the shape, in cross section, of a non-rectangular trapezoid.

15. The fire hydrant wrench of claim 11 in which the handle is secured in the head by engaged threads, and the handle serves to urge said gripping edge into engagement with the fixture.

16. The fire hydrant wrench of claim 11, wherein at least two internal faces of the head, disposed opposite a handle portion of the head, include gripping edges.

* * * * *